US006398576B1

(12) United States Patent
Hwang et al.

(10) Patent No.: US 6,398,576 B1
(45) Date of Patent: Jun. 4, 2002

(54) ELECTRICAL CONNECTOR HAVING BRACKET-COVERED LATCH

(75) Inventors: Jeng-Yih Hwang, Irvine; An-Jen Yang, Rowland Height, both of CA (US)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 09/834,683

(22) Filed: Apr. 13, 2001

(51) Int. Cl.[7] ..... H01R 13/627
(52) U.S. Cl. ..... 439/354; 439/344
(58) Field of Search ..... 439/352–358, 439/344, 701, 418

(56) References Cited

U.S. PATENT DOCUMENTS 5,292,258 A * 3/1994 Sakurai ..... 439/352
5,462,457 A * 10/1995 Schroepfer et al. ..... 439/352 X
5,993,236 A * 11/1999 Vanderhoof et al. ..... 439/344
5,993,237 A * 11/1999 Kern, Jr. et al. ..... 439/344
6,132,233 A * 10/2000 Fukuda ..... 439/357
6,186,819 B1 * 2/2001 Holub ..... 439/358
6,203,352 B1 * 3/2001 Murakami et al. ..... 439/352
6,261,116 B1 * 7/2001 Ceru ..... 439/352

* cited by examiner

*Primary Examiner*—Brian Sircus
*Assistant Examiner*—Son V. Nguyen
(74) *Attorney, Agent, or Firm*—Wei Te Chung

(57) ABSTRACT

An electrical connector comprises a lower half having a first end thereof and an upper half assembled to the lower half. A latch is pivotally assembled to the upper and lower halves and having a free end extending rearward. A bracket is attached to the upper half and covers the free end of the latch.

4 Claims, 7 Drawing Sheets

ELECTRICAL CONNECTOR HAVING BRACKET-COVERED LATCH

FIELD OF THE INVENTION

The present invention relates to an electrical connector, and more particularly to an electrical connector having a plastic latch pivotally assembled thereto. The electrical connector further includes a grounding device for establishing a grounding path with a receptacle in which the electrical connector is mated.

DESCRIPTION OF THE PRIOR ART

Electrical connector with latches is widely used between plug and receptacle connectors to ensure reliable electrical connection therebetween. However, in some circumstance, such as when the plug is made from die-cast, a grounding path is required between the plug and the receptacle.

One of the approaches is to provide a metal latch which functions engagement as well as grounding. However, it is preferable to perform the engagement and grounding between the plug and receptacle separately.

FIG. 6 disclose an approach suggested by Small Form Factor Committee on the HSSDC-2, SFF-8421, Page 17, which is currently attached for reference.

However, the current design of the latch may experience a permanent deformation and which will be detailed described as below. As shown in FIG. 6, both ends of the latch are securely attached to a housing of the plug. As a result, the latch is exposed to axial compression force which inherits an elastic instability. Accordingly, a deformation which exceeds the elastic instability will become a permanent deformation and will not resume to its original position.

As shown in FIGS. 7 and 8, when both ends 901, 902 of the latch 900 are securely attached to the housing 910, axial compression forces 960 are applied to the latch once the latch is applied with a traversal force. Line 920 represents the elastic instability inherited in the prior art model.

In order to provide a locking effect, the latch 900 is provided with a knee 903 which is normally depressed by a user to release the latch 900 from its corresponding receptacle. Apparently, during the unlatching movement of the latch 900, the knee 903 will be depressed completely to ensure a completely unlatch from the receptacle. If the knee 903 is depressed completely, the latch 900 would experience 1) a complete deformation when the knee 903 buckles the elastic instability line 920; and 2) the knee 903 will be suffered from a reverse force.

In the first situation, once the knee 903 is buckled and trapped to its permanent deformation, the latch 900 becomes useless and it cannot be locked to its corresponding receptacle and this will create a great problem because the electrical connection between the plug and receptacle connectors can no longer be ensured.

In the second situation, as stated before, if an upper surface of the knee 903 is exposed with tension force (FIG. 7), then after the knee 903 exceeds line 920, elastic instability line, the upper surface of the knee 903' will be exposed to a compression force (lower one of FIG. 8). Accordingly, after a period of cycle, the latch 900 will be broken right at the knee 903.

In addition, during the downward movement of the latch, an end 901 of the latch 900 will be twisted such that an unwanted force is generated between the engagement between the latch 900 and a retaining bud 911 of the housing 910. This repeated movement will finally separate the first end 901 of the latch 900 from the retaining bud 911 of the housing 910.

On the other hand, even cantilever latch has been widely know to the skill in the art, a free end of the latch may easily flip over when exposed excess upward force. Accordingly, there is still room for providing a reliable latch.

SUMMARY OF THE INVENTION

An objective of this invention is to provide an electrical connector having a latch which is free from axial compression force thereby eliminating potential permanent deformation resulted from elastic instability resulted from axial compression force.

In order to achieve the objective set forth, an electrical connector in according to the present invention includes a lower half having a first end thereof. An upper half is assembled to the lower half. A latch is pivotally assembled to the upper and lower halves and having a free end extending rearward. A bracket is attached to the upper half for limiting upward movement of the free end of the latch.

SUMMARY OF THE DRAWINGS

Other objects and further features of the present invention will be apparent from the following detailed description when read in conjunction with the accompanying drawings, in which.

DETAILED DESCRIPTION OF PREFERRED EMBODIMENT

Figure 1:
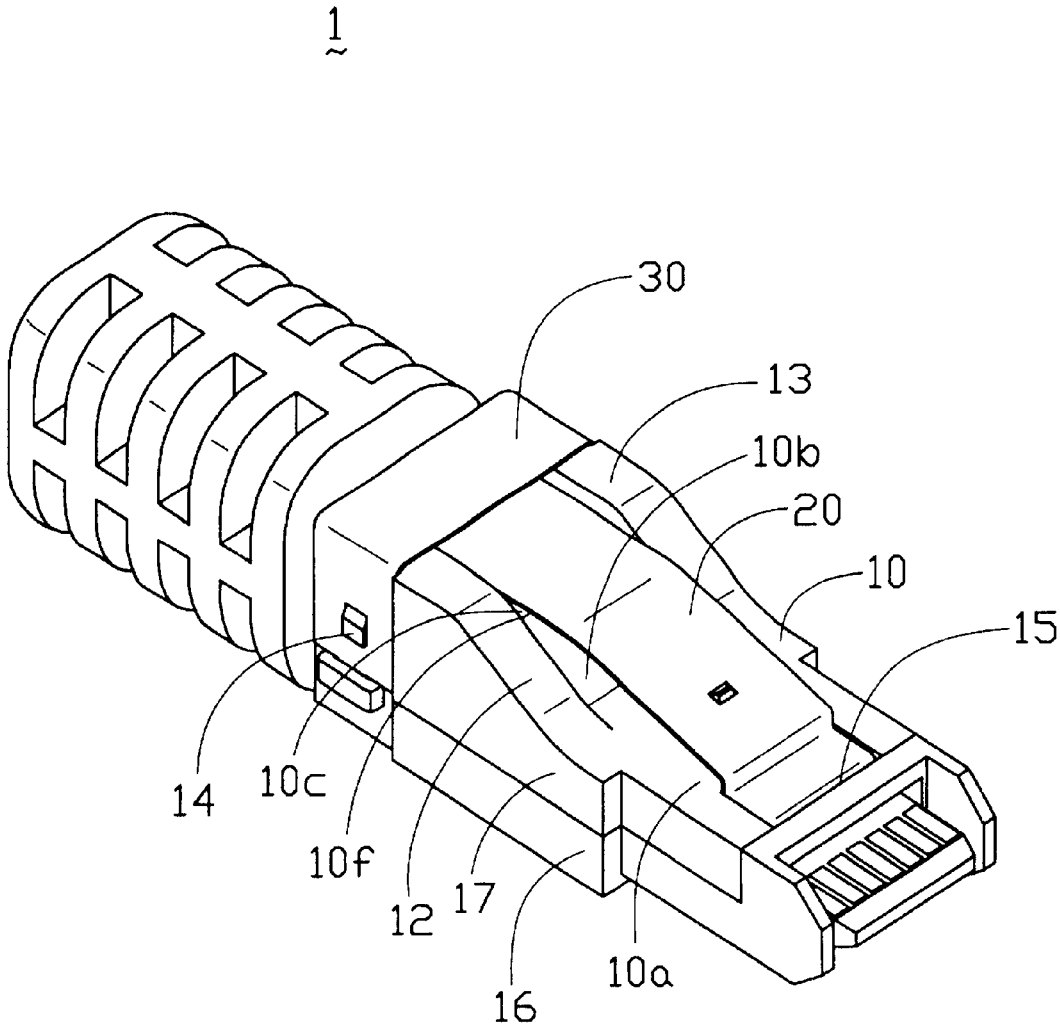
FIG. 1 is a perspective view of an electrical connector in accordance with the present invention.
Figure 2:
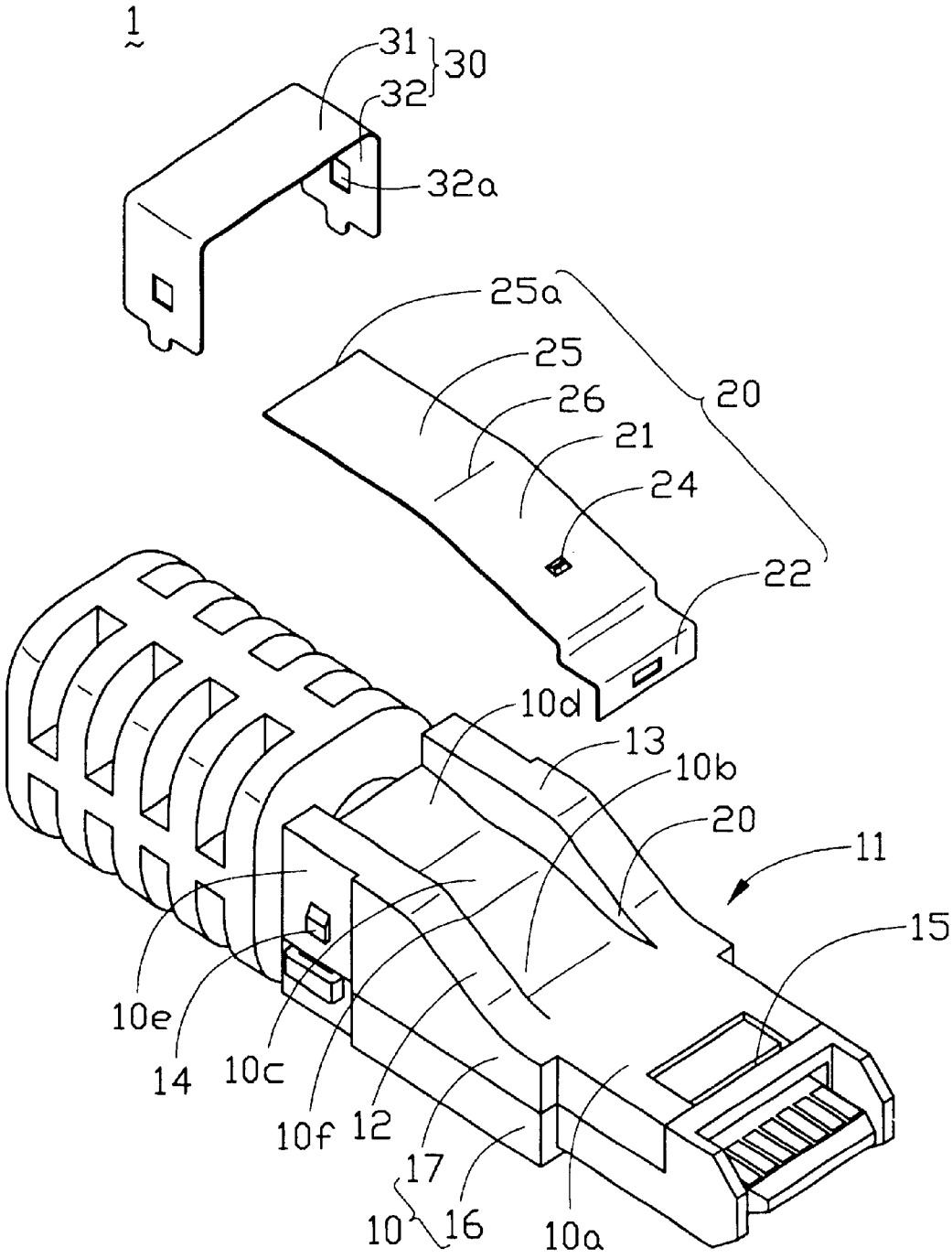
FIG. 2 is an exploded view seen from a reverse direction.
Figure 3:
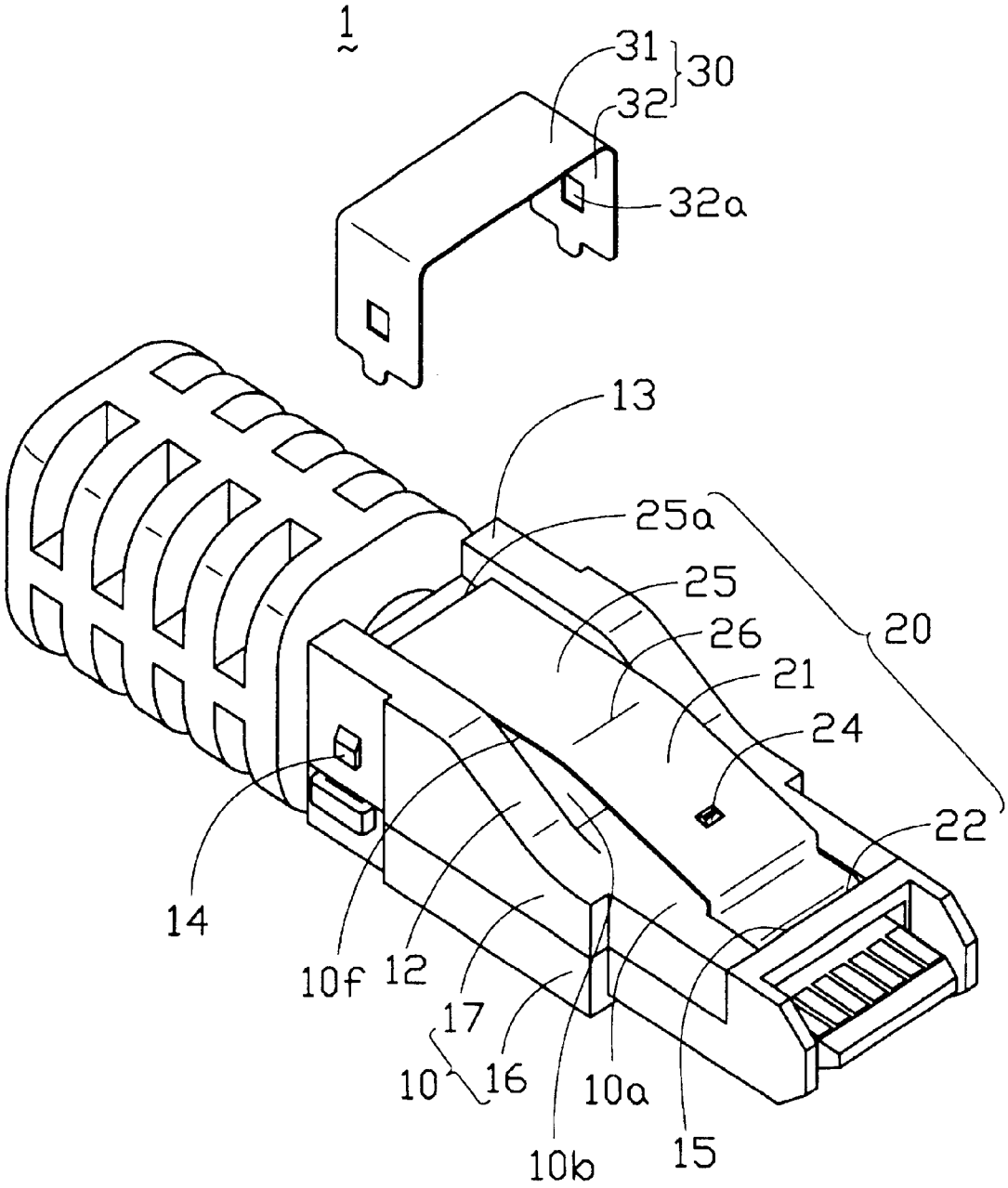
FIG. 3 is similar to FIG. 2 with bracket removed therefrom.

Referring to FIGS. 1 to 4C, an electrical plug connector 1 in accordance with the present invention includes a housing 10 with a latch 20 attached to a first end 11 thereof. A bracket 30 is attached to the housing 10 such that a free end 25*a* thereof is covered by the bracket 30. Detailed description is given below.

The housing 10 defines a top surface 10*a* with a pair of side ribs 12, 13 extending upward from edges of the housing 10 thereby defining a receiving space 14 between the ribs 12, 13. The top surface 10*a* is formed with a shoulder 10*b* to form a plateau 10*c* between the ribs 12, 13. The plateau 10*c* further includes an oblique surface 10*d*. The housing 10 further includes a pair of retaining buds 14 on sidewall 10*e*. The housing 10 is configured by a lower half 16, and an upper half 17 assembled to the lower half 16.

The latch 20 includes a base portion 21 having a clip 24 extending upward therefrom, a bouncing portion 25 adjacent to the base portion 21, and an anchoring tail 22 securely received in a slit 15 of the housing 10. A knee 26 is formed between the base portion 21 and the bouncing portion 25. When the latch 20 is attached to the housing 10, the bouncing portion 25 is located within the ribs 12, 13. Since the ribs 12, 13 have a certain height with respect to the plateau 10*c*, the bounding portion 25 is free to move vertically within the ribs 12, 13.

The bracket 30 generally includes a base plate 31, and a pair of side flaps 32 having a retaining window 32*a* defined therein. When the bracket 30 is attached to the housing 10, the bracket 30 is straddled over the ribs 12, 13 and having the retaining windows 32*a* of the flaps 32 engaged with the retaining buds 14 of the sidewall 10*e*. As described above, the bouncing portion 25 extends between the ribs 12, 13, when the bracket 30 is attached to the housing 10, the free end 25*a* and portion of the bouncing portion 25 are covered by the base plate 31 of the bracket 30. Accordingly, not only the free end 25*a* is free to move, but also the free end 25*a* is covered from being incidentally pried out.

One of the advantages of the present invention is the latch 20 is provided with a free end 25*a*. As a result, the elastic instability of the prior art is completely eliminated from the present invention.

In addition, since the bouncing portion 25 is partially located within the ribs 12, 13, unless the latch 20 is received a downward force adjacent to the knee 26, the clip 24 will not be released. By this arrangement, the clip 24 can be completely protected from incidentally unlatching.

Figure 4A:
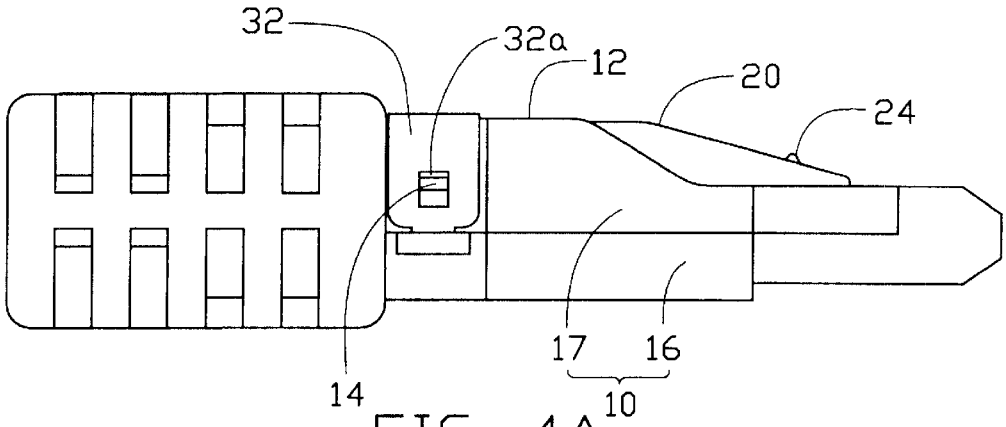
FIG. 4A is a left side view of FIG. 1.
Figure 4B:
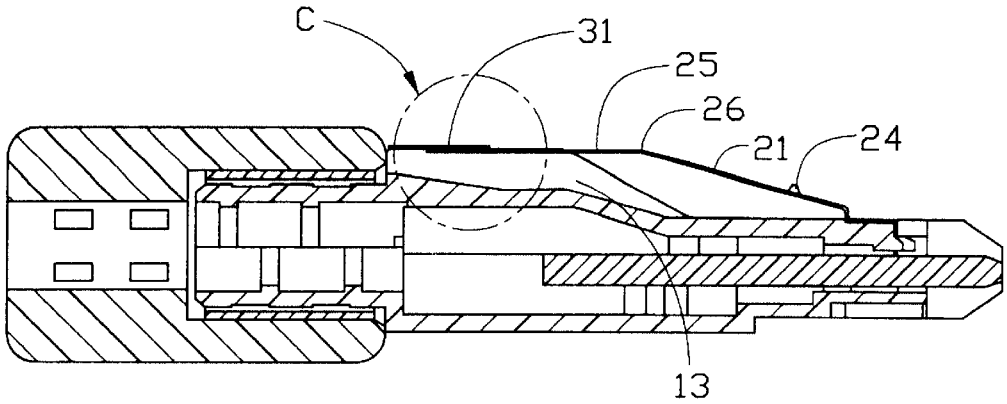
FIG. 4B is a cross sectional view taken from a central plane of FIG. 1.
Figure 4C:
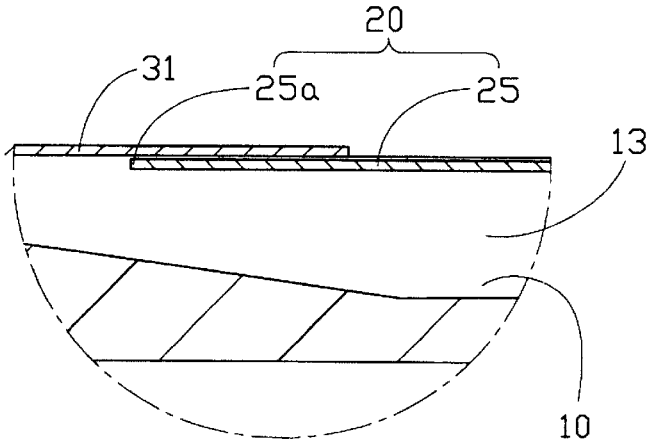
FIG. 4C is an enlarged view encircled in FIG. 4B.

FIGS. 4B and 4C clearly disclose the bouncing portion 25 is partially covered by the base plate 31 of the bracket 30 and the free end 25*a* of the bouncing portion 25 is completely covered under the base plate 31. By this arrangement, the defect encountered by the prior art is completely solved.

Figure 5A:
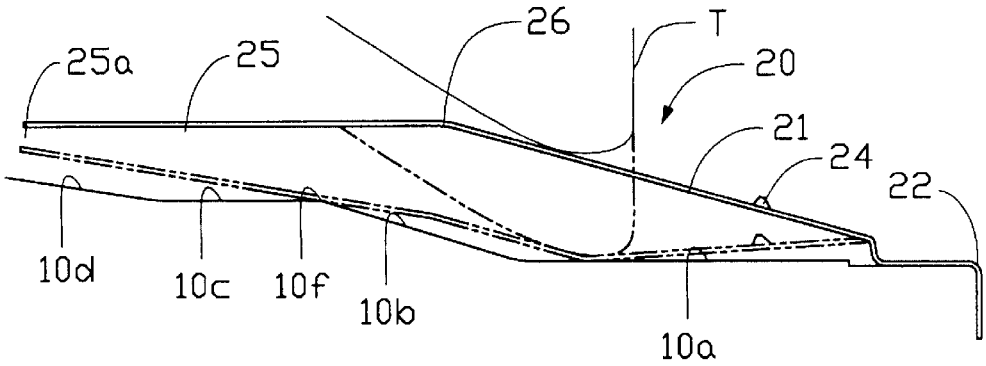
FIG. 5A is a first simulation view for the connector of FIG. 1.
Figure 5B:
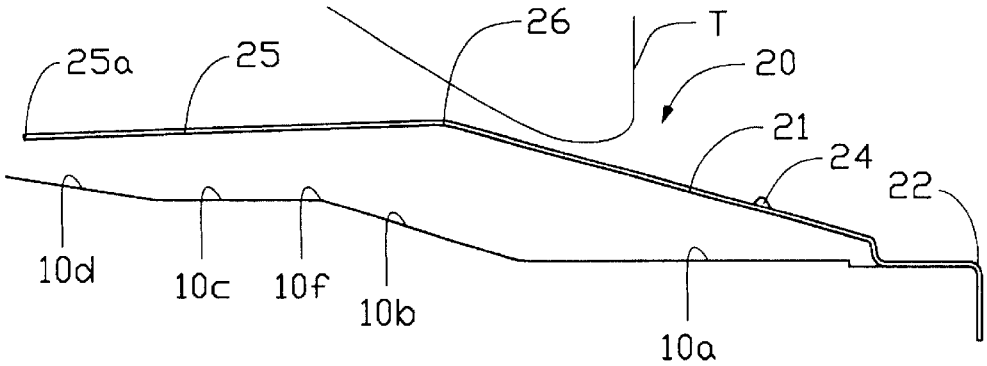
FIG. 5B is a second simulation view for the connector of FIG. 1.
Figure 6:
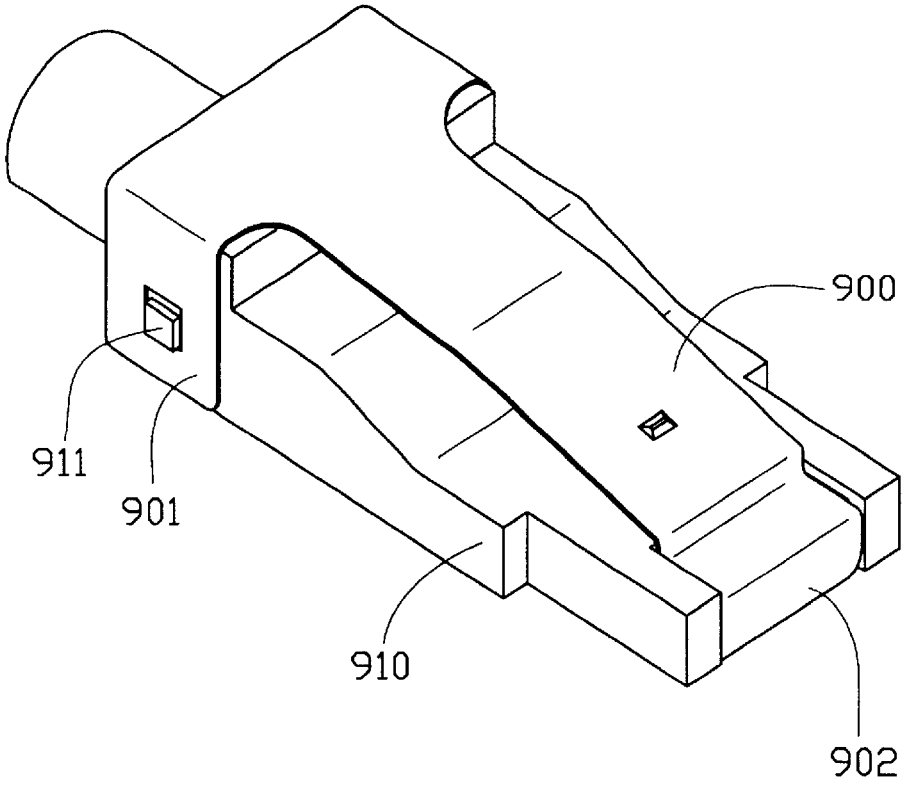
FIG. 6 (PRIOR ART)
FIG. 6 is a perspective view of a prior art plug connector with a latch mounted thereon.
Figure 7:
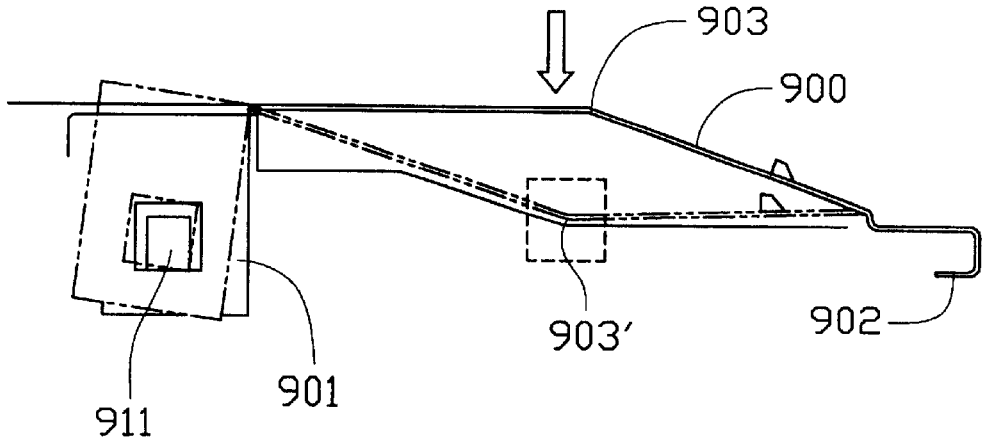
FIG. 7 (PRIOR ART)
FIG. 7 is a first simulation view for the prior art connector of FIG. 6.
Figure 8:
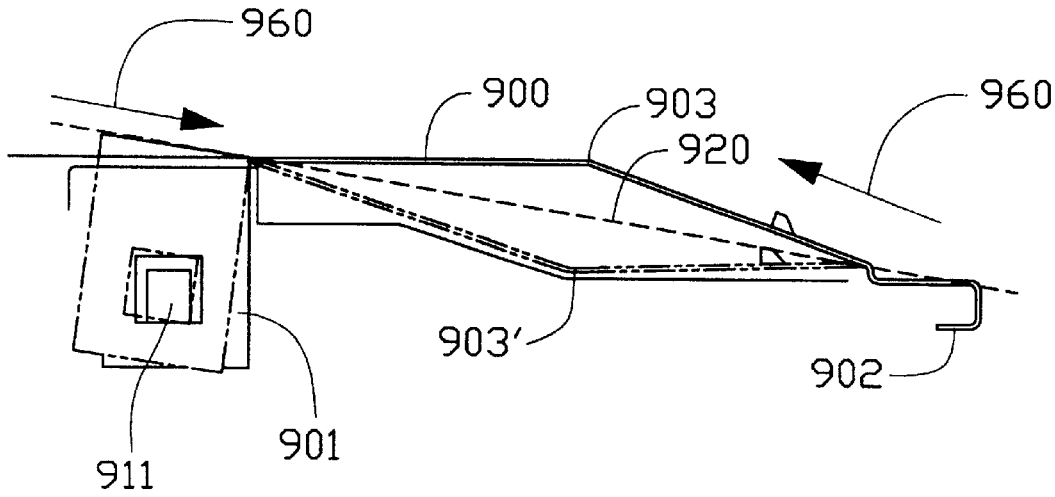
FIG. 8 (PRIOR ART)
FIG. 8 is a second simulation view for the prior art connector of FIG. 6.

Referring to FIGS. 5A and 5B, a simulation of the latch 20 of the present invention are shown.

As shown in FIG. 5A, when a force T is applied downward adjacent to the knee 26, both the bouncing portion 25, and the base portion 21 start to move downward, the clip 24 is moved downward also to be released from a corresponding latch (not shown). When the base portion 21 hits to the top face 10*a*, the bouncing portion 25 hits an edge 10*f* of the shoulder 10*b*, thereby providing a bouncing force to the latch 20. Since the free end 25*a* is free to move, in this embodiment, it directing either upwardly or longitudinally, the elastic instability is completely eliminated. As a result, once the force T is removed, the latch 20 resumes to its original position without any permanent deformation, as shown in FIG. 5B.

It is noted that from the viewpoint of mechanics of materials, the prior art design belongs to the beam with two fixed ends under deflection. Differently, the invention performs a simple (support) beam where one end is fixed while the other end is free to move, under deflection, along the longitudinal direction of the beam, i.e., the lengthwise direction of the latch 20 wherein the free end is further protectively sandwiched between the protecting bracket 30 and the supporting housing 10.

We claim:

1. An electrical connector comprising:

a housing;

a deflectable metal latch defining a latching clip thereon, and two opposite fixed and free ends along a longitudinal direction of the latch, the fixed end being fixed to the housing and the free end being free to move along said longitudinal direction on the housing during deflection; and a locking clip formed on the latch around the fixed end; wherein in deflection, a middle portion of the latch engages the housing in a vertical direction perpendicular to said longitudinal direction while the free end and said locking clip are still spaced from the housing in said vertical direction; wherein a separate metal bracket is attached to the housing and covers the free end of the latch.

2. The electrical connector as recited in claim 1, wherein a limiting means includes a pair of ribs formed on a top face of the housing and the latch extends partially between the ribs.

3. The electrical connector as recited in claim 2, wherein the housing includes a plateau rising from a top face thereof and located within the ribs of the housing.

4. The electrical connector as recited in claim 1, wherein the free end of the latch extends into the space between the ribs of the housing.

* * * * *